US005331524A

United States Patent [19]

Tseng

[11] Patent Number: 5,331,524

[45] Date of Patent: Jul. 19, 1994

[54] UMBRELLA WITH LIGHTING DEVICE

[75] Inventor: Chuen-Jong Tseng, Chiayi Hsien, Taiwan

[73] Assignee: Shin Yeh Enterprise Co., Ltd., Taiwan

[21] Appl. No.: 88,224

[22] Filed: Jul. 6, 1993

[51] Int. Cl.[5] ..... A45B 3/02

[52] U.S. Cl. ..... 362/102; 362/431; 362/127

[58] Field of Search ..... 362/102, 431, 153, 153.1, 362/352, 391, 127

[56] References Cited

U.S. PATENT DOCUMENTS

| | | | |
|---|---|---|---|
| 2,087,537 | 7/1937 | Finkel | 362/102 |
| 3,313,929 | 4/1967 | Schiavone | 362/102 |
| 3,777,136 | 12/1973 | Okuda | 362/102 |

*Primary Examiner*—Ira S. Lazarus
*Assistant Examiner*—Sara Sachie Raab
*Attorney, Agent, or Firm*—Ladas & Parry

[57] ABSTRACT

An umbrella includes a hollow shank that is open at an upper end. A hollow lamp holder unit is provided on the upper end of the shank and has a closed upper end to which a plurality of ribs are connected, an open lower end formed with a central hole to permit the shank to extend into the lamp holder unit, and a positioning rod which extends from the upper end and into the shank. The positioning rod has a longitudinal groove formed on a periphery thereof. A slidable ring is sleeved on the shank. A plurality of spreaders are connected pivotally to a periphery of the ring member at one end and are connected pivotally and respectively to the ribs at the other end. A lighting element is mounted securely on the lower end of the lamp holder unit adjacent to the central hole. An electric cable unit is disposed inside the shank and extends through the groove in the positioning rod and into the lamp holder unit, thereby interconnecting the lighting element electrically with a power source. A support member is secured on the shank between the lamp holder unit and the ring member and is spaced apart from the lamp holder unit. A transparent tubular cover is retained removably between the lamp holder unit and the support member to permit removal of the lighting element when the cover is removed.

8 Claims, 4 Drawing Sheets

UMBRELLA WITH LIGHTING DEVICE

BACKGROUND OF THE INVENTION

1. Field Of The Invention

This invention relates to an umbrella, more particularly to an umbrella with a lighting device that is mounted securely on the shank of the umbrella.

2. Description Of The Related Art

Referring to FIG. 1, a conventional umbrella includes a main shank 91. A support member 92 is mounted on the top end of the main shank 91. A plurality of ribs 93 are connected pivotally to the periphery of the support member 92 at one end to support a canopy (not shown) thereon. A slidable ring 94 is sleeved on the shank 91. A plurality of spreaders 95 are connected pivotally to the periphery of the ring 94 at one end and are connected pivotally and respectively to the ribs 93 at the other end. The ring 94 is movable between a first position, wherein the ribs 93 are adjacent to the main shank 91, and a second position, wherein the ribs 93 form an angle with the main shank 91 so as to open the canopy. When the umbrella is used at the night, a lighting device is provided on the umbrella and is activated to give light. The lighting device includes an electric cable 96 which is wound on a respective one of the spreaders 95 and the shank 91. The electric cable 96 has a first end connected electrically to a power source (not shown) and a second end with a lamp 97 connected electrically thereto such that the lamp 97 is suspended from the respective one of the spreaders 95.

The drawbacks of the above-described conventional umbrella are as follows:

1. Swinging of the lamp 97 when there if a strong wind, thereby resulting in possible damage thereto.
2. The electric cable 96 is exposed, thereby resulting in rapid wearing of the same.
3. Since the lamp 97 is exposed and since the surface of the lamp 97 has a relatively high temperature after a relatively long period of use, scorching occurs when a body part contacts the lamp 97 accidentally.

SUMMARY OF THE INVENTION

Therefore, the objective of the present invention is to provide an umbrella with a lighting device that can overcome the drawbacks commonly associated with the above described prior art.

According to this invention, an umbrella includes a shank with an upper end, a plurality of ribs connected pivotably to the upper end of the shank at one end thereof, a slidable ring sleeved on the shank, and a plurality of spreaders which are connected pivotally to a periphery of the ring member at one end and which are connected pivotally and respectively to the ribs at the other end. The shank is hollow and is open at the upper end. A hollow lamp holder unit is provided on the upper end of the shank and has a closed upper end, an open lower end which is formed with a central hole to permit the shank to extend into the lamp holder unit, and a positioning rod which extends from the upper end and into the shank. The positioning rod has a longitudinal groove formed on a periphery thereof. The upper end of the lamp holder unit interconnects pivotally the shank and the one end of each of the ribs. A lighting element is mounted securely on the lower end of the lamp holder unit adjacent to the central hole. An electric cable unit is disposed inside the shank. The cable unit has a lower end connected to a power source and an upper end which extends into the groove of the positioning rod and into the lamp holder unit and which is connected electrically to the lighting element. A support member is secured on the shank between the lamp holder unit and the ring member and is spaced apart from the lamp holder unit. A transparent tubular cover is retained removably between the lamp holder unit and the support member to permit removal of the lighting element when the tubular cover is removed.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
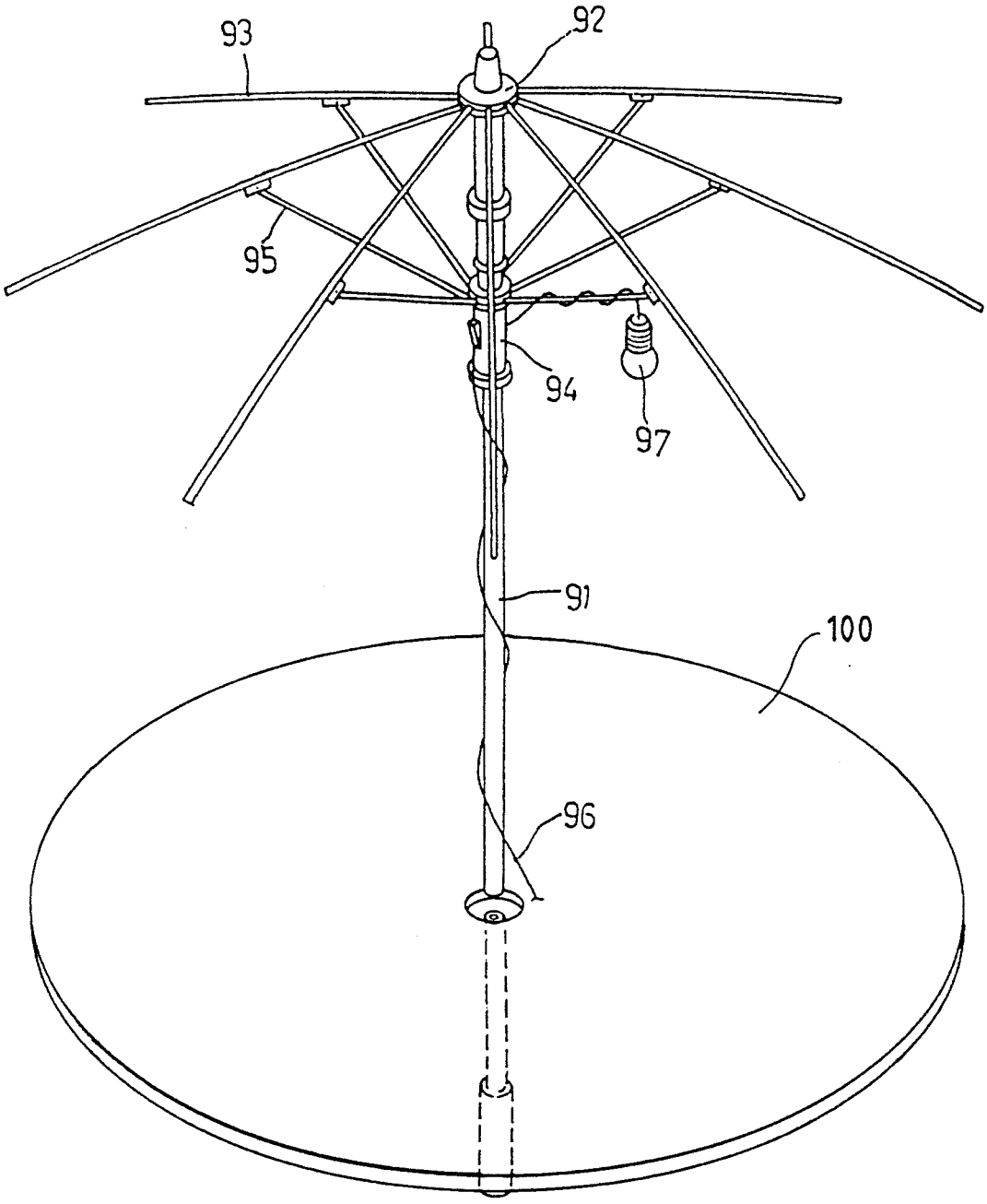
FIG.1 PRIOR ART
FIG. 1 is a perspective view of a conventional umbrella which is provided with a lamp.
Figure 2:
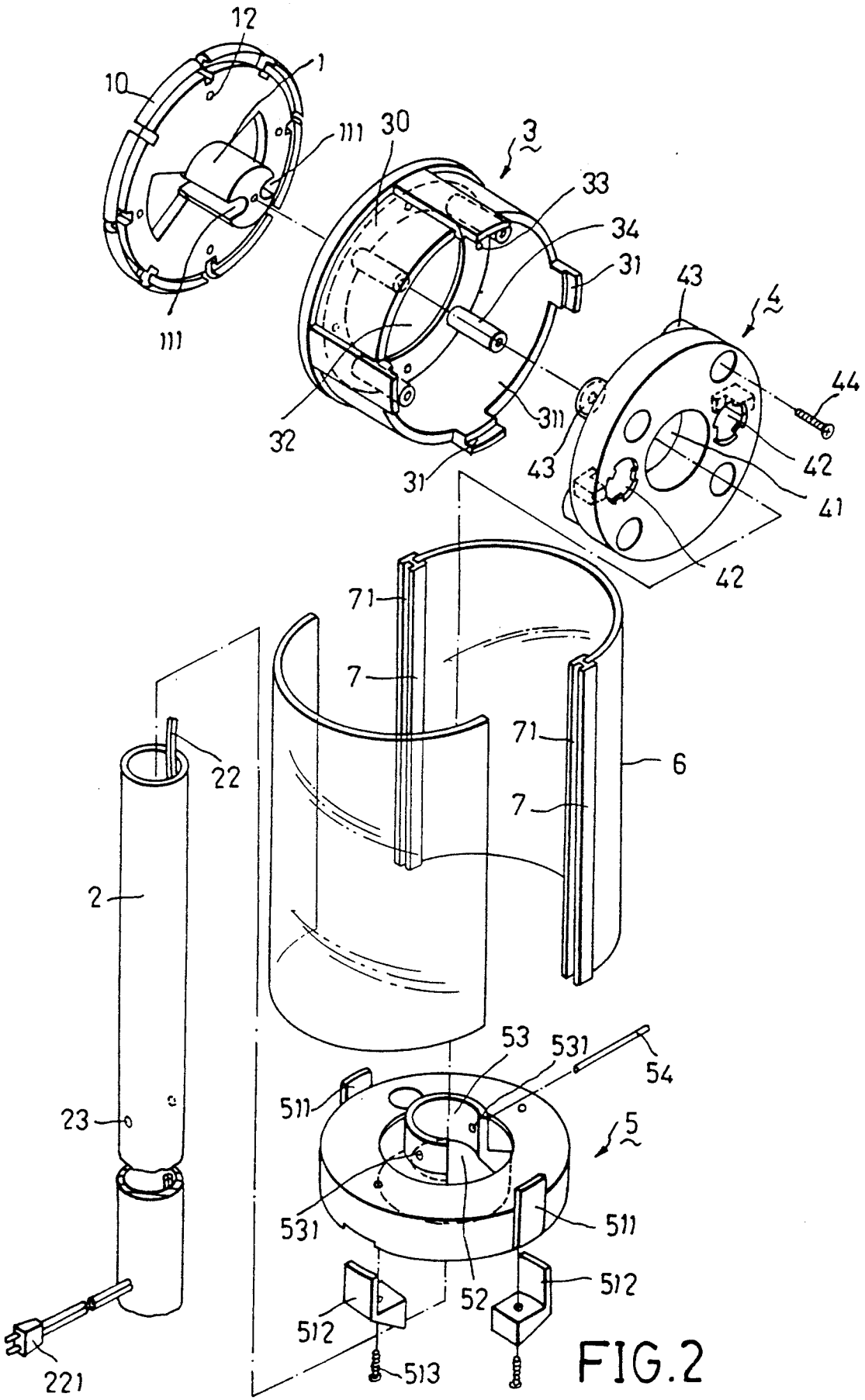
FIG. 2 is an exploded view showing an umbrella with a lighting device according to a first embodiment of the present invention.
Figure 3:
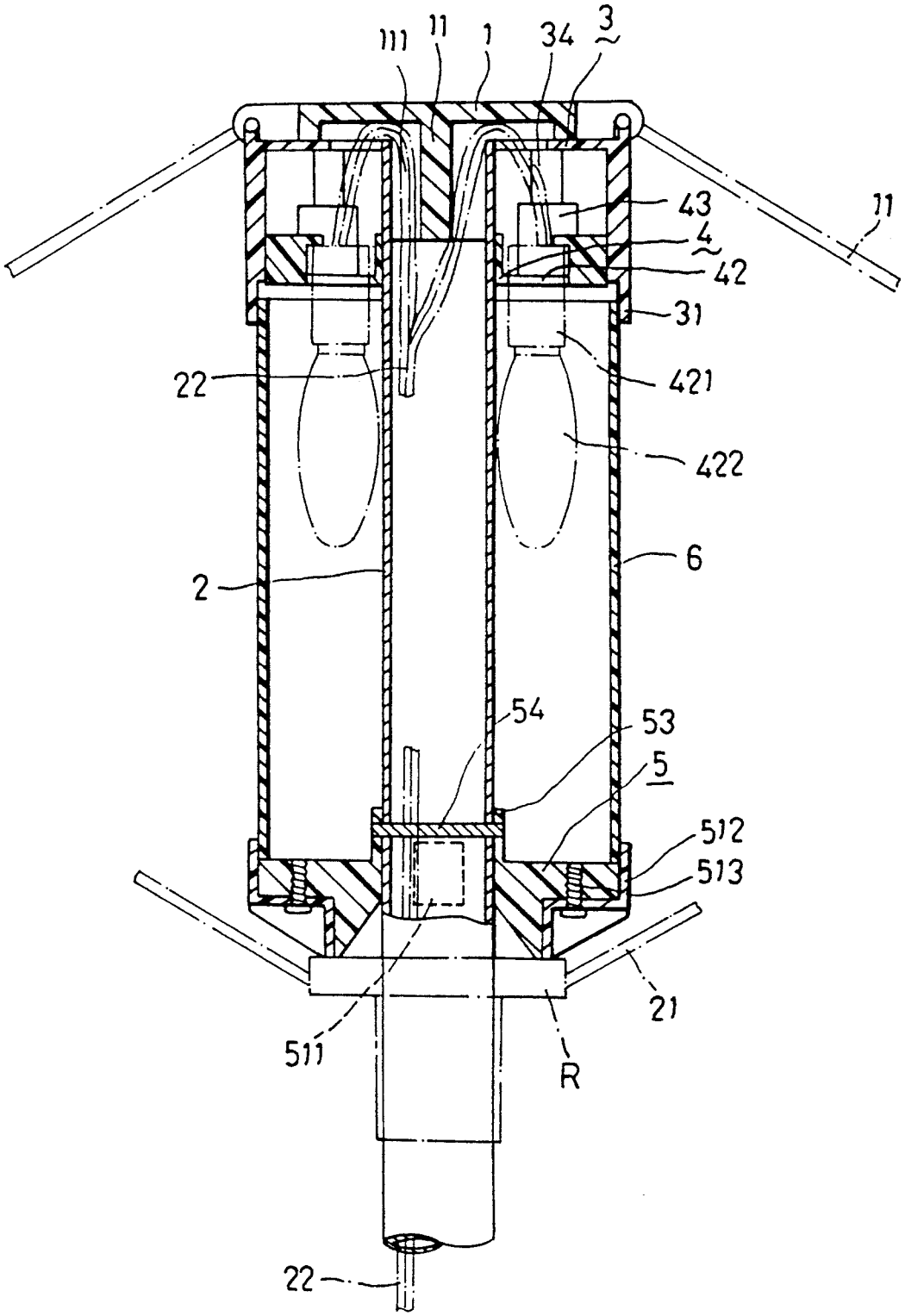
FIG. 3 is a fragmentary sectional view showing the assembly of the umbrella with a lighting device according to the first embodiment of the present invention.

Referring to FIGS. 2 and 3, an umbrella with a lighting device according to a first embodiment of this invention includes a shank 2 with an upper end, a plurality of ribs 11, a slidable ring (R), a plurality of spreaders 21, a hollow lamp holder unit, two lighting elements, an electric cable unit 22, a support member 5 and a transparent tubular cover 6.

The shank 2 is hollow and is open at the upper end. Two diametrically opposite positioning holes 23 are formed in the shank 2 and are spaced apart from the upper end of the shank 2.

The lamp holder unit includes a positioning rod 1, a hollow cylindrical member 3 and a connecting member 4 which has two lamp holder 421 mounted thereon. The positioning rod 1 has an upper end and a lower end. The upper end has an annular outward flange 10 which extends radially outward therefrom and which has a plurality of angularly spaced locking holes 12 formed in the outward flange 10. The positioning rod 1 further has two diametrically opposite and axially extending longitudinal grooves 111 formed in the periphery thereof. The ribs 11 are angularly spaced and are connected pivotally to the periphery of the outward flange 10. The ribs 11 support a canopy (not shown) thereon. The cylindrical member 3 has an open upper end and an open lower end. The upper end of the cylindrical member 3 has an annular inward flange 30 extending radially inward therefrom so as to define a central hole 32 thereat. Four claw elements 31 are provided on the periphery of the lower end of the cylindrical member 3 and are angularly spaced from each other. Each of the claw elements 31 extends downwardly from the lower end of the cylindrical member 3. A plurality of angularly spaced locking holes 33 are formed in the inward flange 30. A hollow locking rod 34 is provided between two adjacent locking holes 33 and extends downwardly from the inward flange 30. The positioning rod 1 extends into the cylindrical member 3 via the upper end of the cylindrical member 3. The outward flange 10 is connected to the inward flange 30 of the cylindrical member 3 by extending locking bolts (not shown) into the locking holes 12,33 in the outward and inward flanges 10,30 in such a in the outward and inward flanges 10,30, thereby closing the upper end of the cylindrical member. The connecting member 4 is formed as a circular disk and has a central hole 41 and two diametrically opposite positioning holes 42 at two sides of the central hole 41 for receiving two lighting elements therein. Each of the lighting elements includes a lamp holder 421 which is received in a respective one of the positioning holes 42, and a lamp 422 which is mounted on the lamp holder 421. A plurality of angularly spaced and hollow upright locking posts 43 are provided on a top side of the connecting member 4 and are connected to the positioning rods 34 of the cylindrical member 3 by extending locking bolts 44 (only one is shown in FIG. 2) through the connecting member 4 and into the locking posts 43 and the locking rods 34 so as to retain the connecting member 4 in the cylindrical member 3. The connecting member 4 further has a reflective bottom surface. The central hole 41 in the connecting member 4 permits the upper end of the shank 2 to extend into the cylindrical member 3 in such a manner that the lower end of the positioning rod 1 extends into the shank 2, thereby retaining the lighting elements on the upper end of the shank 2.

The slidable ring (R) is sleeved on the shank 2. The spreaders 21 are connected pivotally to the periphery of the ring (R) at one end and are connected pivotally and respectively to the ribs 11 at the other end. The connection between the ribs 11 and the spreaders 21 is conventional and is not shown in the drawings. The ring (R) is movable between a first position, wherein the ribs 11 are adjacent to the shank 2, and a second position, wherein the ribs 11 form an angle with the shank 2 so as to open the canopy (not shown), as shown in FIG. 3.

An electric cable unit 22 is disposed inside the shank 2. The cable unit 22 has a lower end to be connected to a power source (not shown) and an upper end which is branched so as to extend into the grooves 111 of the positioning rod 1 and into the lamp holder unit order to connect electrically with the lamps 422 of the lighting element. The power source may be a battery unit (not shown) provided on an appropriate position of the shank 2. When the umbrella with a lighting device according to the present invention is to be used as a garden umbrella, the shank 2 is adapted to be positioned on a garden table 100. The lower end of the electric cable unit 22 is provided with a plug 221 so as to connect with an electric outlet (not shown).

The support member 5 has a circular inner wall which confines a central hole 52 in the support member 5. A hollow tubular projection 53 projects upwardly from the periphery of the inner wall of the support member 5. The projection 53 has two diametrically opposite locking holes 531 formed in the periphery thereof. The central hole 52 and the projection 53 permit extension of the shank 2 therethrough. The support member 5 is secured on the shank 2 between the lamp holder unit and the ring member (R) by extending a positioning pin 54 through the positioning holes 23 in the shank 2 and the locking holes 531 in the projection 53 of the support member 5. Two claw elements 511 are provided securely on the periphery of the support member 5 and are diametrically opposite to each other, while two claw elements 512 are mounted removably on the support member 5 by means of locking bolts 513 and are disposed opposite to each other. Each of the claw elements 511,512 extends upwardly from the support member 5.

The transparent tubular cover 6 is retained removably between the lamp holder unit and the support member 5 by means of the claw elements 31 on the cylindrical member 3 of the lamp holder unit and the claw elements 511,512 on the support member 5 so as to provide a shield for the lighting element. The transparent tubular cover 6 includes two longitudinal halves and two coupling elements 7. Each of the claw elements 512 on the support member 5 abuts against an outer surface of the lower end of a respective one of the longitudinal halves. Each of the coupling elements 7 is an elongated member formed with two opposed elongated engaging grooves 71 for receiving the planar edges of the longitudinal halves of the cover 6 therein, thereby interconnecting removably the longitudinal halves of the cover 6. When one of the claw units 511 on the support member 5 is removed, the corresponding one of the longitudinal halves can be removed so as to permit removal of one of the lamps 422.

Figure 4:
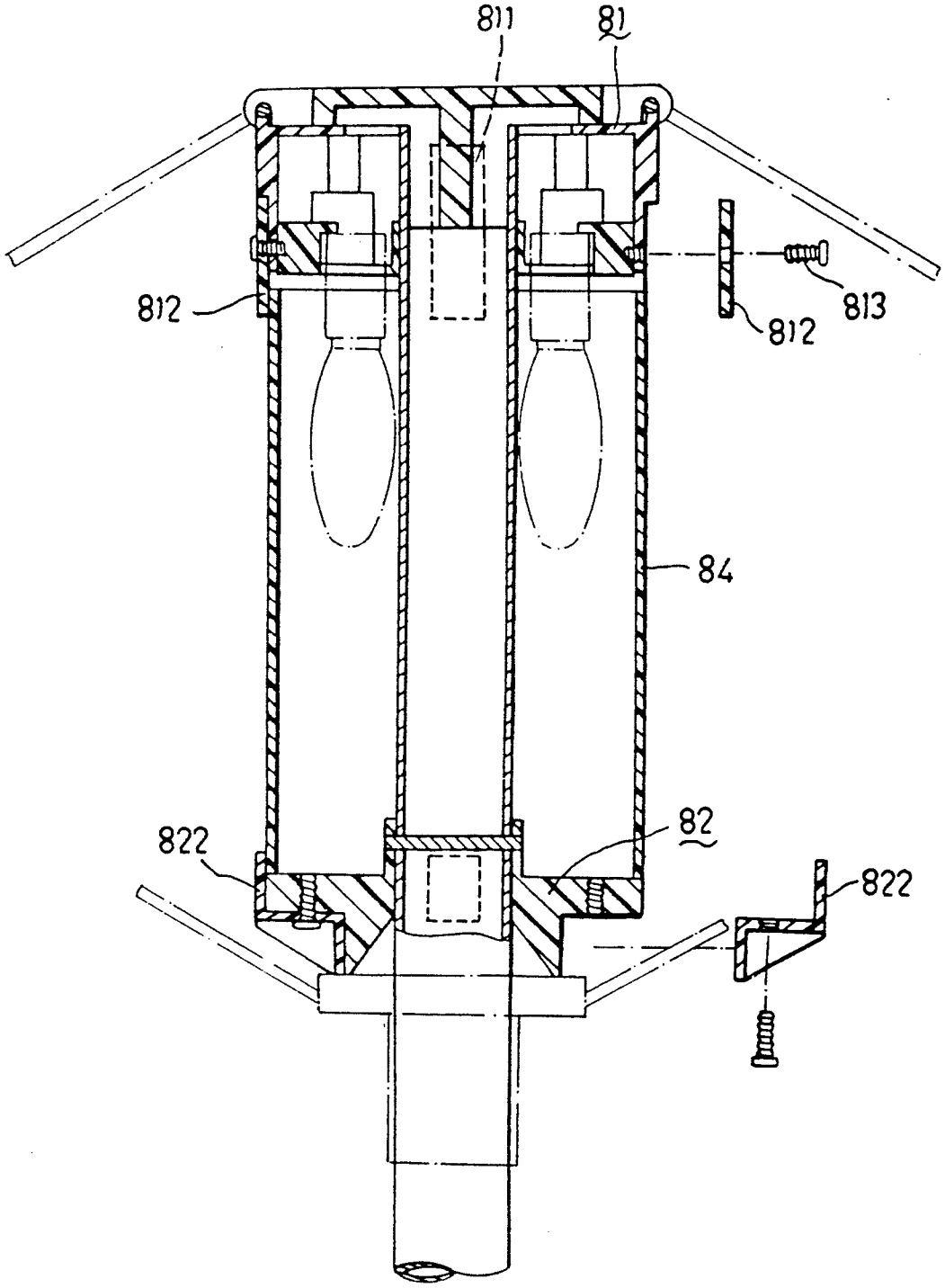
FIG. 4 is a fragmentary sectional view showing the umbrella with a lighting device according to a second embodiment of the present invention.

A second embodiment of an umbrella with a lighting device according to the present invention is shown in FIG. 4. Unlike the first embodiment, two claw elements 811 are provided securely on the periphery of the cylindrical member 81 and are diametrically opposite to each other (only one is shown in phantom lines), while two claw elements 812 are mounted removably on the cylindrical member 81 by means of locking bolts 813 and are diametrically opposite to each other. Therefore, one of the longitudinal halves of the tubular cover 84 can be removed when one of the claw units 812 on the cylindrical member 81 and one of the claw units 822 on the support member 82 is removed.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. An umbrella with a lighting device, said umbrella including a shank with an upper end, a plurality of ribs connected pivotably to said upper end of said shank at one end thereof, a slidable ring sleeved on said shank, and a plurality of spreaders which are connected pivotally to a periphery of said ring member at one end and which are connected pivotally and respectively to said ribs at the other end, wherein the improvement comprises:

said shank being hollow and being open at said upper end;

a hollow lamp holder unit which is provided on said upper end of said shank and which has a closed upper end, an open lower end which is formed with a central hole to permit said shank to extend into said lamp holder unit, and a positioning rod which extends from said upper end and into said shank, said positioning rod having a longitudinal groove formed on a periphery thereof, said upper end of said lamp holder unit interconnecting pivotally said shank and said one end of each of said ribs;

a lighting element mounted securely on said lower end of said lamp holder unit adjacent to said central hole;

an electric cable unit disposed inside said shank, said cable unit having a lower end to be connected to a power source and an upper end which extends into said groove of said positioning rod and into said lamp holder unit and which is connected electrically to said lighting element;

a support member which is secured on said shank between said lamp holder unit and said ring member and which is spaced apart from said lamp holder unit; and a transparent tubular cover retained removably between said lamp holder unit and said support member to permit removal of said lighting element when said tubular cover is removed.

2. An umbrella with a lighting device as claimed in claim 1, wherein each of said lamp holder unit and said support member has a plurality of claw elements provided on a periphery thereof to retain said transparent tubular cover therebetween, at least one of said claw elements on said lamp holder unit and said support member being removable therefrom so that said tubular cover can be removed when said at least one of said claw elements is removed.

3. An umbrella with a lighting device as claimed in claim 2, wherein said transparent tubular cover includes two longitudinal halves and two coupling elements which interconnect removably said longitudinal halves so that one of said longitudinal halves can be removed when said at least one of said claw units is removed.

4. An umbrella with a lighting device as claimed in claim 1, wherein said lower end of said lamp holder unit has a reflective bottom surface.

5. A garden umbrella to be installed on a garden table and provided with a lighting device, said garden umbrella including a shank with an upper end, a plurality of ribs connected pivotably to said upper end of said shank at one end thereof, a slidable ring sleeved on said shank, and a plurality of spreaders which are connected pivotally to a periphery of said ring member at one end and which are connected pivotally and respectively to said ribs at the other end, wherein the improvement comprises:

said shank being hollow and being open at said upper end, said shank being adapted to be positioned on said garden table, said shank further having a lower end;

a hollow lamp holder unit which is provided on said upper end of said shank and which has a closed upper end, an open lower end which is formed with a central hole to permit said shank to extend into said lamp holder unit, and a positioning rod which extends from said upper end and into said shank, said positioning rod having a longitudinal groove formed on a periphery thereof, said upper end of said lamp holder unit interconnecting pivotally said shank and said one end of each of said ribs;

a lighting element mounted securely on said lower end of said lamp holder unit adjacent to said central hole;

an electric cable unit disposed inside said shank, said cable unit having a lower end which extends out of said lower end of said shank and which is provided with a plug so as to connect with an electric outlet, and an upper end which extends into said groove of said positioning rod and into said lamp holder unit and which is connected electrically to said lighting element;

a support member which is secured on said shank between said lamp holder unit and said ring member and which is spaced apart from said lamp holder unit; and a transparent tubular cover retained removably between said lamp holder unit and said support member to permit removal of said lighting element when said tubular cover is removed.

6. A garden umbrella as claimed in claim 5, wherein each of said lamp holder unit and said support member has a plurality of claw elements provided on a periphery thereof to retain said transparent tubular cover therebetween, at least one of said claw elements on said lamp holder unit and said support member being removable therefrom so that said tubular cover can be removed when said at least one of said claw elements is removed.

7. A garden umbrella as claimed in claim 6, wherein said transparent tubular cover includes two longitudinal halves and two coupling elements which interconnect removably said longitudinal halves so that one of said longitudinal halves can be removed when said at least one of said claw units is removed.

8. A garden umbrella as claimed in claim 5, wherein said lower end of said lamp holder unit has a reflective bottom surface.

* * * * *